US007749042B2

(12) United States Patent
Fulgenzi

(10) Patent No.: US 7,749,042 B2
(45) Date of Patent: Jul. 6, 2010

(54) TOY BUILDING SET

(75) Inventor: Ettore Fulgenzi, Rome (IT)

(73) Assignee: Giochi Puliti S.R.L., Turin (IT)

( * ) Notice: Subject to any disclaimer, the term of this patent is extended or adjusted under 35 U.S.C. 154(b) by 516 days.

(21) Appl. No.: 11/883,013

(22) PCT Filed: Mar. 6, 2006

(86) PCT No.: PCT/IB2006/000568

§ 371 (c)(1),
(2), (4) Date: Jul. 25, 2007

(87) PCT Pub. No.: WO2006/097820

PCT Pub. Date: Sep. 21, 2006

(65) Prior Publication Data

US 2008/0146114 A1 Jun. 19, 2008

(30) Foreign Application Priority Data

Mar. 18, 2005 (IT) ..... TO2005A0183

(51) Int. Cl.
*A63H 33/08* (2006.01)
*A63H 33/00* (2006.01)

(52) U.S. Cl. ..... 446/108; 446/93; 446/124

(58) Field of Classification Search ..... 446/85, 446/93, 94, 108, 111–114, 120, 124, 476, 446/478, 487; 52/591.2, 591.1; 273/153 R, 273/156

See application file for complete search history.

(56) References Cited

U.S. PATENT DOCUMENTS

| | | | | | |
|---|---|---|---|---|---|
| 1,890,269 | A | * | 12/1932 | Swanson | 446/115 |
| 2,057,942 | A | * | 10/1936 | Fay | 446/112 |
| 3,692,201 | A | * | 9/1972 | Garduna | 217/12 R |
| 3,701,214 | A | * | 10/1972 | Sakamoto | 446/115 |
| 4,173,287 | A | * | 11/1979 | Kumakawa | 217/65 |
| 4,253,268 | A | * | 3/1981 | Mayr | 446/104 |
| 4,270,304 | A | * | 6/1981 | Sofer | 446/106 |
| 4,355,781 | A | * | 10/1982 | Stolpin | 249/64 |
| 4,761,315 | A | * | 8/1988 | Logan et al. | 428/33 |
| 4,792,319 | A | * | 12/1988 | Svagerko | 446/104 |
| 5,215,490 | A | | 6/1993 | Szoradi | |
| 5,259,803 | A | | 11/1993 | Lyman | |
| 5,853,314 | A | * | 12/1998 | Bora | 446/120 |
| 6,186,855 | B1 | * | 2/2001 | Bauer et al. | 446/104 |
| 6,925,770 | B2 | * | 8/2005 | Sorensen et al. | 52/591.2 |
| D591,007 | S | * | 4/2009 | O'Neill | D30/121 |
| 7,648,407 | B1 | * | 1/2010 | Sorensen | 446/120 |

FOREIGN PATENT DOCUMENTS

| | | |
|---|---|---|
| DE | 92 00 474 U1 | 4/1992 |
| WO | WO 00/56415 A | 9/2000 |

* cited by examiner

*Primary Examiner*—Kien T Nguyen
(74) *Attorney, Agent, or Firm*—Modiano & Associati; Albert Josif; Daniel J. O'Byrne

(57) ABSTRACT

The toy building set comprises interconnectable modular elements that include flat, substantially square bricks, each having two opposite, substantially square main faces, of which a first one is shaped with an array of recesses. Two first, adjacent, narrow side faces bear tabs projecting at right angles from the respective side faces. Two second, adjacent, narrow side faces bear forks projecting from the respective side faces so that the tabs of an adjacent brick can be inserted therein. Each fork is of a size and shape such that it is insertable in one of the recesses with a tight fit. The modular elements also comprise disc-shaped, peripherally toothed bricks, each having transverse openings in which the forks are insertable.

14 Claims, 2 Drawing Sheets

TOY BUILDING SET

The present invention relates to a toy building set of the type comprising a plurality of modular molded elements made of a synthetic material, so-called "bricks", which can be linked together with a tight fit to build tridimensional models representing fancy figures or real objects such as buildings, vehicles, pieces of furniture, as well as animals, plants, etc.

BACKGROUND OF THE INVENTION

The toy building sets of the above type are generally packed in cartons containing a predetermined number of bricks. The simplest bricks typically have a prismatic profile with a square or rectangular contour and, although they may differ from one another for size and shape, they have the common feature of being provided with projections on one base, which are shaped to fit into corresponding recesses formed on one opposite base. Alternatively, certain bricks may have only one base provided with projections or recesses.

None of the known toy building sets have bricks which can be both stacked on top of each other and linked side by side and at right angles. This deficiency considerably affects the versatility of the toy and the creative possibilities that the toy offers.

The toy building sets have evolved over the years, with the production of a variety of assorted bricks having more and more complex shapes specifically intended for creating predetermined profiles. Consequently, such bricks have a limited polyvalence and high manufacturing costs due to their complexity and to the high variety of different shapes.

SUMMARY OF THE INVENTION

Therefore, it is a main object of the present invention to provide a toy building set comprising only one type of brick, or two types at most, which are shaped such to have a high polyvalence, with possibility of articulated lateral connections, in order to allow complex profiles to be formed even by using a small number of bricks.

A further object of the invention is to provide the above bricks with a high degree of safety in relation to the use of the toy by children.

The above objects and other aims and advantages, which will better appear below, are achieved by the toy building set having the features recited in claim 1, while the other claims state other advantageous features of the invention.

BRIEF DESCRIPTION OF THE DRAWINGS

The invention will be now described in more detail with reference to a preferred, non-exclusive embodiment shown by way of non limiting example in the attached drawings, wherein.

DESCRIPTION OF THE PREFERRED EMBODIMENTS

Figure 1:
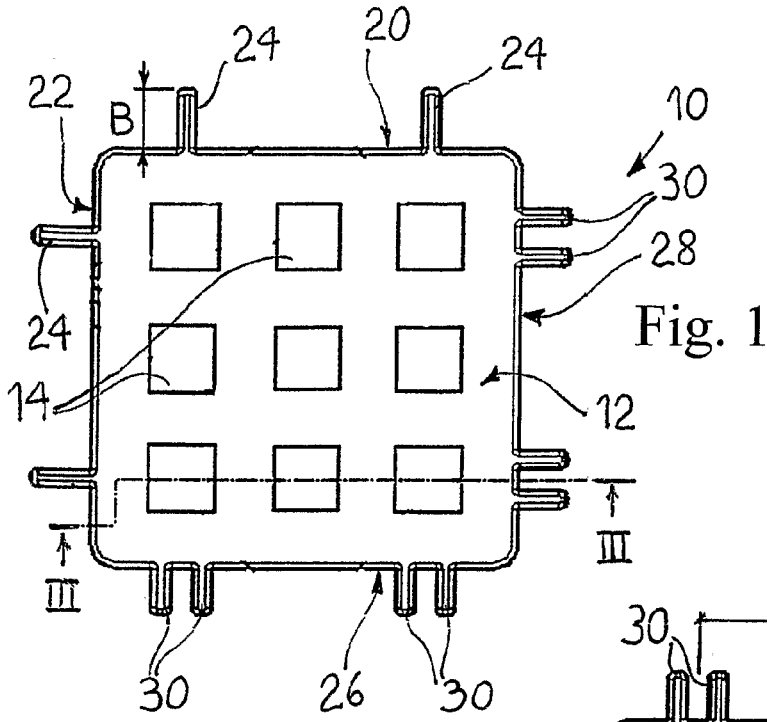
FIG. 1 is a plan view from above of a first brick belonging to a toy building set according to the invention.
Figure 2:
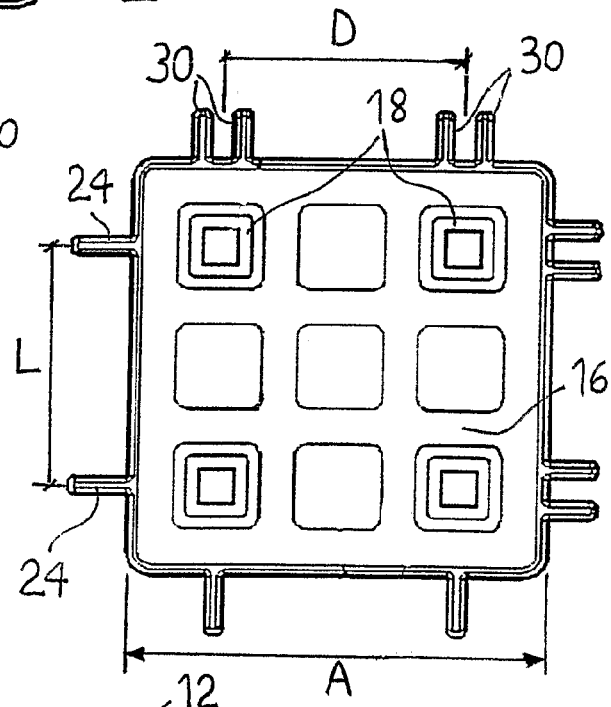
FIG. 2 is a plan view from below of the brick of FIG. 1.
Figure 3:
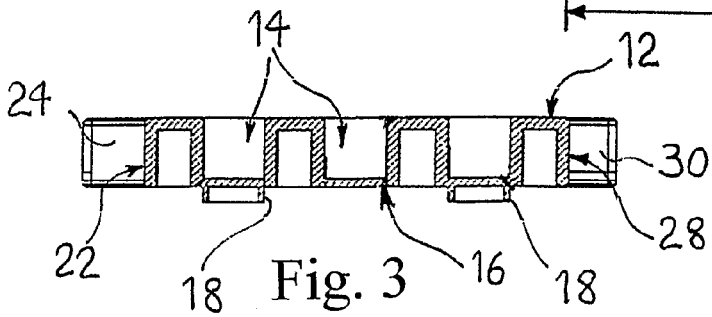
FIG. 3 is a view in cross section of the brick of FIG. 1 made along line III-III.

With reference to the above Figures, a toy building set according to the invention comprises two different types of modular elements connectable together with a tight fit. FIGS. 1-3 illustrate an element of the first type which consists of a flat brick having a square contour 10 with two opposite main faces. A first main face 12 has nine square-shaped recesses such as 14 arranged in a square array. The second main face 16 has four square-shaped bosses such as 18 which are aligned to the four corner recesses 14 of the square array and are sized to engage the recesses with a tight fit. Brick 10 has four level, side faces. Two adjacent side faces 20, 22 are each provided with two rectangular tabs 24 arranged at right angles to the respective side face and to the main faces, and aligned to two peripheral rows of shaped recesses. The other two side faces 26, 28 are each provided with two forks 30. Each fork consists of a pair of side-by-side rectangular fins arranged at right angles to the respective side face and to the main faces. The fins of the forks are mutually arranged such that a tab is insertable therebetween with a tight fit, and the distance D between centers of the two forks is equal to the distance L between two tabs 24. Moreover, each fork 30, as well as each tab 24, has an outer profile engageable into recesses 14 with a tight fit. Preferably, the distance between the centers of two adjacent recesses equals the distance between the center of a peripheral recess and the adjacent side edge, plus a half of the length of tab 24. As the person skilled in the art will appreciate, with this arrangement, the distance between centers of two recesses belonging to different bricks interconnected laterally is always a multiple of the distance between two adjacent recesses.

Figure 4:
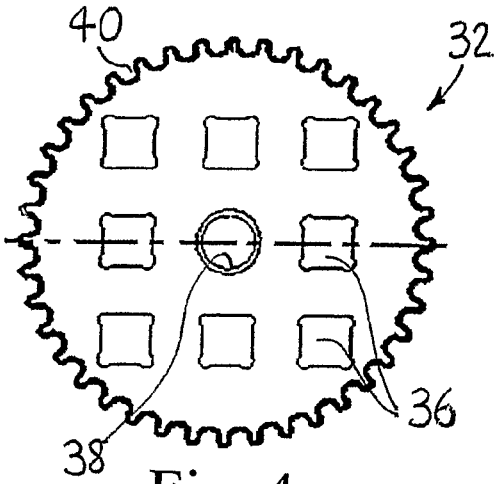
FIG. 4 is a plan view from above of a second brick belonging to the toy building set according to the invention.
Figure 5:
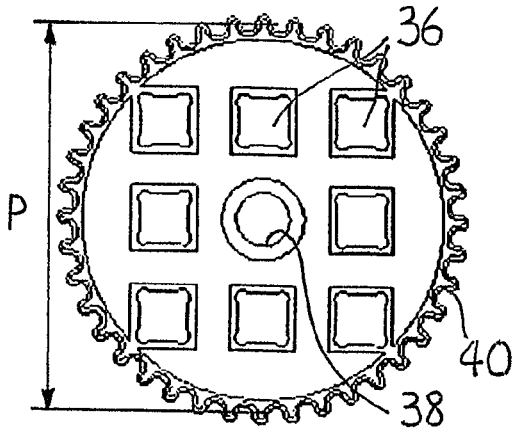
FIG. 5 is a plan view from below of the brick of FIG. 4.
Figure 6:
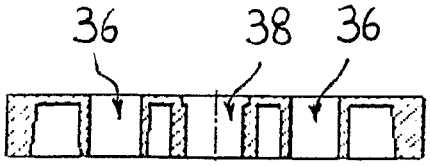
FIG. 6 is a view in cross section of the brick of FIG. 4 made along line VI-VI.

FIGS. 4-6 illustrate an element of the second type which consists of a disc-shaped brick 32. Disc-shaped brick 32 has eight transverse openings such as 36 arranged in a square array and aligned to the eight peripheral recesses 14 of square bricks 10. The eight openings 36 have a square profile corresponding to recesses 14 for being engaged by forks 30, as well as by bosses 18 and by tabs 24. Disc-shaped brick 32 is provided with an axial hole 38 and with a peripheral toothing 40. Advantageously, the pitch diameter P of toothing 40 of the disc-shaped brick is substantially equal to the length of side A of the square brick plus the length B of tabs 24. As the person skilled in the art will immediately understand, this allows two disc-shaped bricks pivoted at the middle of respective adjacent square bricks to mesh with each other.

Figure 7:
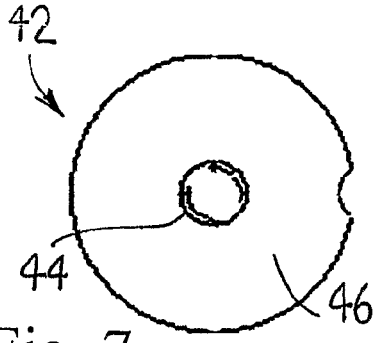
FIG. 7 is a plan view from above of an auxiliary element belonging to the toy building set according to the invention.
Figure 8:
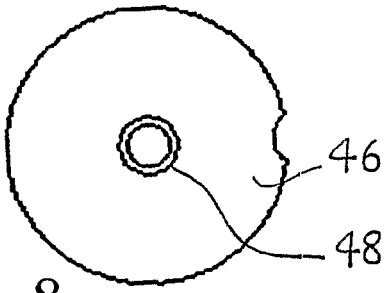
FIG. 8 is a plan view from below of the auxiliary element of FIG. 7.
Figure 9:
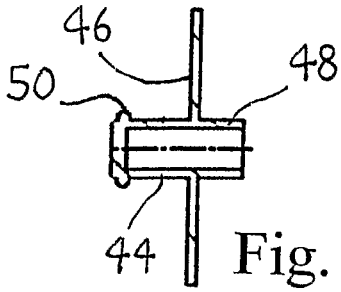
FIG. 9 is a view in cross section of the auxiliary element of FIG. 7 along line IX-IX.

An accessory pivot member 42 is shown in FIGS. 7-9. Pivot member 42 has a circular profile, with a pin-shaped end portion 44 which is pivotally insertable into axial hole 38 of disc-shaped brick 32, and with a cylindrical end portion 48 opposite to pin 44 and insertable with a tight fit into the recesses of square bricks 10 or into the openings of disc-shaped bricks 32. Pivot member 42 is also preferably provided with an intermediate thin spacer flange 46. The free end of pin 44 is surrounded by a peripheral edge 50, whereby pin 44 is inserted into axial hole 38 with a snap action.

In use, recesses 14 on square bricks and openings 36 on disc-shaped bricks cooperate with bosses 18 and tabs 24 of square bricks, to allow the square bricks to be stacked both on top of other square bricks and on top of disc-shaped bricks. Tabs 24 cooperate with the forks 30 to allow the square bricks both to be interconnected laterally, and to be connected at right angles to other square bricks and to disc-shaped bricks.

The square profile of recesses 14, square openings 36, and bosses 18, prevents two joined bricks from rotating with respect to each other even when the connection is provided by the mutual engagement of only one boss 18 or fork 30 in a corresponding recess 14 or opening 36.

Figure 10:
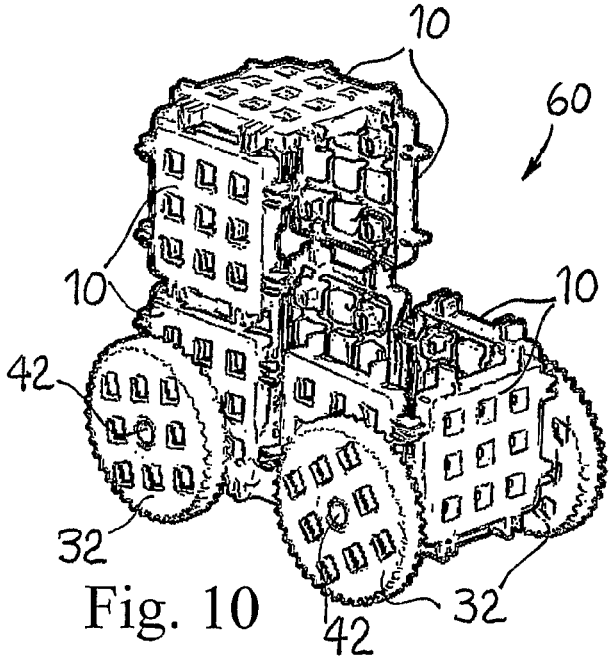
FIG. 10 is a pictorial image of a model built with the toy building set according to the invention.

FIG. 10 is a pictorial image of a composition representing a car 60. The composition is formed by twelve square bricks 10 which are laterally joined at right angles to form a frame, and four disc-shaped bricks representing the wheels and pivoted to respective pivot members 42, each inserted in a corresponding recess 14 of the square bricks forming the side walls of the frame. Although in FIG. 10 all the square bricks are joined at right angles, the shape of the tabs and forks allows lateral connections at different angles, with a large amount of possible configurations.

A preferred embodiment has been described herein, but of course many changes may be made by the person skilled in the art within the scope of the inventive concept. For example, the number of recesses and/or bosses on the square bricks, as well as the number of openings on the disc-shaped bricks may be varied. The number of tabs and/or forks on each lateral face may also be different from what illustrated.

What is claimed is:

1. A toy building set comprising interconnectable modular elements, wherein said modular elements include flat, substantially square bricks, each having:

two opposite, substantially square main faces, of which a first one is shaped with an array of recesses, two first, narrow side faces bearing tabs projecting at right angles from respective side faces, two second, narrow side faces bearing forks projecting from the respective side faces so that the tabs of an adjacent brick can be inserted therein, each fork being of a size and shape such that it is insertable in one of said recesses with a tight fit.

2. The toy building set of claim 1, wherein each fork comprises a pair of parallel fins projecting at right angles from the respective side face.

3. The toy building set of claim 1, wherein each of said substantially square bricks is provided with bosses projecting from a second one of said main faces and insertable in said recesses with a tight fit.

4. The toy building set of claim 3, wherein said recesses and said bosses are substantially square.

5. The toy building set of claim 1, wherein each of said substantially square bricks has nine of said recesses arranged in a square array.

6. The toy building set of claim 5, wherein each of said substantially square bricks has four of said bosses respectively aligned with four corner recesses of the square array.

7. The toy building set of claim 1, wherein a distance between the centers of two adjacent recesses, in any of said bricks is substantially equal to a distance between a center of a peripheral recess of the square array and a midpoint of the adjacent tab of the brick.

8. The toy building set of claim 1, wherein each of said substantially square bricks is provided with two tabs on each of said first side faces, and with two forks on each of said second side faces, a distance between the two tabs being equal to a distance between centers of two forks.

9. The toy building set of claim 1, wherein said modular elements also comprise disc-shaped, peripherally toothed bricks, each having transverse openings in which said forks are insertable.

10. The toy building set of claim 9, wherein each of said disc-shaped bricks has eight of said recesses arranged in a square array around its axis.

11. The toy building set of claim 10, wherein said openings are square.

12. The toy building set of claim 9, wherein said disc-shaped brick has an axial hole, and comprising pivot members having one end portion insertable into the axial hole, and with an opposite end portion insertable in one of the recesses of a square brick or openings of a disc-shaped brick.

13. The toy building set of claim 12, wherein said one end portion of the pivot member is freely rotatable in the axial hole of a disc-shaped brick.

14. The toy building set of claim 9, wherein a pitch diameter of the peripheral toothing of the disc-shaped brick is substantially equal to a length of a side of the substantially square brick plus a length of the tab.

* * * * *